US005203195A

United States Patent [19]

Ritter et al.

[11] Patent Number: 5,203,195

[45] Date of Patent: Apr. 20, 1993

[54] BENDING MACHINE FOR BENDING BAR-SHAPED MATERIAL

[75] Inventors: Klaus Ritter; Gerhard Ritter; Gerhard Schmidt, all of Graz, Austria

[73] Assignee: EVG Entwicklungs-u.Vertwertungs-Gesellschaft mbH, Graz, Austria

[21] Appl. No.: 761,824

[22] PCT Filed: Jan. 2, 1991

[86] PCT No.: PCT/AT91/00001

§ 371 Date: Sep. 4, 1991

§ 102(e) Date: Sep. 4, 1991

[87] PCT Pub. No.: WO91/10519

PCT Pub. Date: Jul. 25, 1991

[30] Foreign Application Priority Data

Jan. 12, 1990 [AT] Austria ..... 61/90

[51] Int. Cl.[5] ..... B21D 7/02

[52] U.S. Cl. ..... 72/387; 72/218

[58] Field of Search ..... 72/217, 218, 219, 387, 72/307

[56] References Cited

U.S. PATENT DOCUMENTS 3,670,541 6/1972 Peddinghaus .
3,894,422 7/1975 Peddinghaus ..... 72/217
4,571,974 2/1986 Pollhammer et al. .
5,025,651 6/1991 Del Fabro et al. ..... 72/217

FOREIGN PATENT DOCUMENTS 525244 5/1931 Fed. Rep. of Germany .
1096168 12/1960 Fed. Rep. of Germany ..... 72/217
2221185 11/1973 Fed. Rep. of Germany .
2514369 10/1976 Fed. Rep. of Germany ..... 72/217
3816005 11/1988 Fed. Rep. of Germany .
2091930 1/1972 France .
2177934 11/1973 France .
363545 9/1962 Switzerland .

*Primary Examiner*—David Jones
*Attorney, Agent, or Firm*—Frishauf, Holtz, Goodman & Woodward

[57] ABSTRACT

Disclosed is a machine for bending rod-shaped material in two directions, comprising a rotable plate (5), fitted with a centrally positioned mandrel (12) and an eccentrically positioned bending tool (13), and a fixed, adjustable holder (15; 17). The plate is mounted coaxial to a housing (1) which is in turn mounted to rotate in a fixed support about an axis (X—X) (4). The plate can be turned by means of a rotary drive (18) mounted on the housing. The holder is positioned eccentrically on the housing and can be brought by means of the rotary drive (18) up against the material to be bent.

18 Claims, 2 Drawing Sheets

BENDING MACHINE FOR BENDING BAR-SHAPED MATERIAL

FIELD OF THE INVENTION

Figure 1:
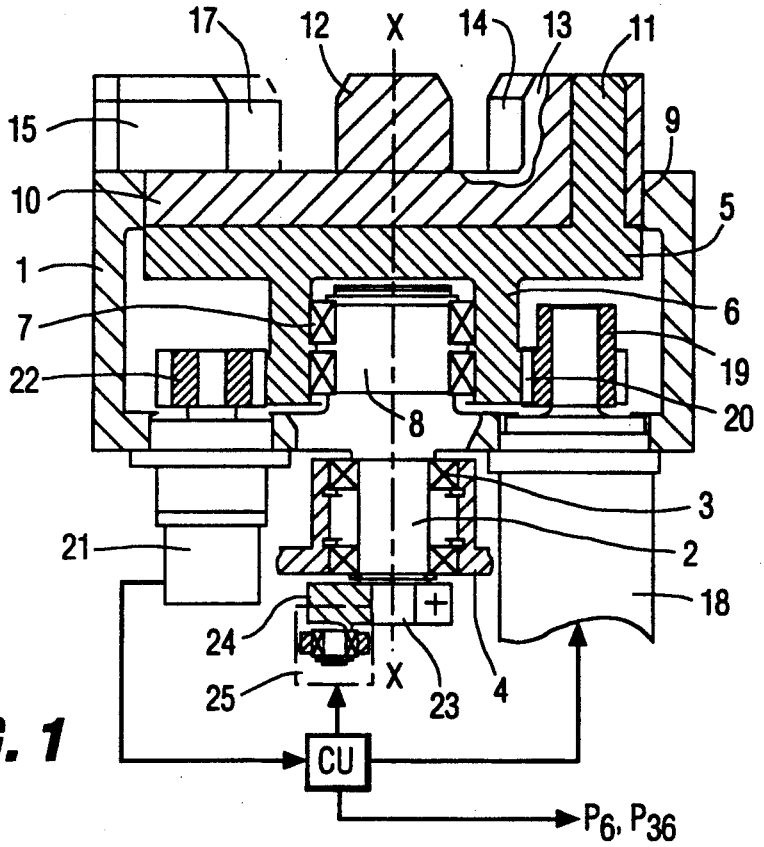

The invention relates to a bending machine for bending bar-shaped material in two directions.

BACKGROUND

Bending machines are known which have a rotatable bending disc, which is provided with a central bending mandrel and an eccentrically located bending tool, and a stationary, adjustable steadying arm.

A bending machine of this type, which is suitable for bending wires, bars, pipes or the like, is known from German Patent Disclosure Document 22 21 185, Fasholz. In that machine, the steadying arm is inserted into stationary slotted control arms, which are displaceable in their longitudinal direction in accordance with the diameter of the material to be bent. The bending disc is located with its bending tools between the slotted control arms. At the beginning of each bending operation, the stationary steadying arm and the eccentrically located bending tool are both on one side of the material to bent, and the central bending mandrel is located on the opposite side. When the bending direction changes, the material to be bent must be located on the opposite side of the central bending mandrel, and both the steadying arm and the eccentric bending tool must be moved to the other side of the material to be bent. The steadying arm is reinserted manually into the corresponding slot of the slotted control arm, and the control arm must sometimes additionally be readjusted in its longitudinal direction.

The disadvantage of this construction is that setting up the steadying arm entails considerable effort, and because of the manual reinsertion and adjustment, mistakes cannot be precluded.

A bending machine is also known from German Patent Disclosure Document 38 16 005 Peruzzi, in which a pair of movable steadying arms is supported on a stationary frame carrying the bending disc. Each steadying arm can be pivoted by a drive mechanism out of a working position into a position of repose. Depending on the bending direction, one steadying arm at a time, in its working position, cooperates with the bending tools, while the other steadying arm is contrarily pivoted 90° into the position of repose, so as not to hinder the bending motion of the bending tool. If the diameter of the material to be bent changes, the steadying arms are displaced vertically with respect to their stop face, which is in the working position, by the aid of drive elements. This construction has the disadvantage that driving and controlling the two steadying arms is very complicated and expensive, and it also has the deficiency that because the working position of the steadying arms is defined fixedly relative to the bending elements, only the ends of the bars can be bent in different directions at a time.

THE INVENTION

It is an object to create a bending machine of the generic type referred to at the outset above, which avoids the disadvantages of the known versions discussed above and in a simple manner enables automatic adjustment of the steadying arm to the material to be bent, without needing additional aids and regardless of the bending direction.

Briefly, the bending disc of the bending machine is supported coaxially in a housing which is rotatably supported about an axis in a stationary frame. The bending disc is rotatable by means of a rotary drive mechanism mounted on the housing. A steading element or arm is eccentrically located on the housing and by means of the rotary drive mechanism can be placed against the material to be bent.

In accordance with a preferred embodiment of the invention, the housing is preadjustable, for coarse positioning of the steadying element or arm, in a position predefined by the applicable bending direction, with the aid of a swivel arm mounted on a bearing journal of the housing and actuatable by an associated swivel drive mechanism.

In a further feature of the invention, the bending disc is rotatably supported on the side of the bearing journal of the housing remote from the swivel arm.

With a structurally simple, compact design of the bending machine, the invention makes it simple to adjust and readjust the bending head for receiving and machining bar-shaped material of varying diameter and to perform bending in opposite directions.

DRAWINGS

Figure 2:
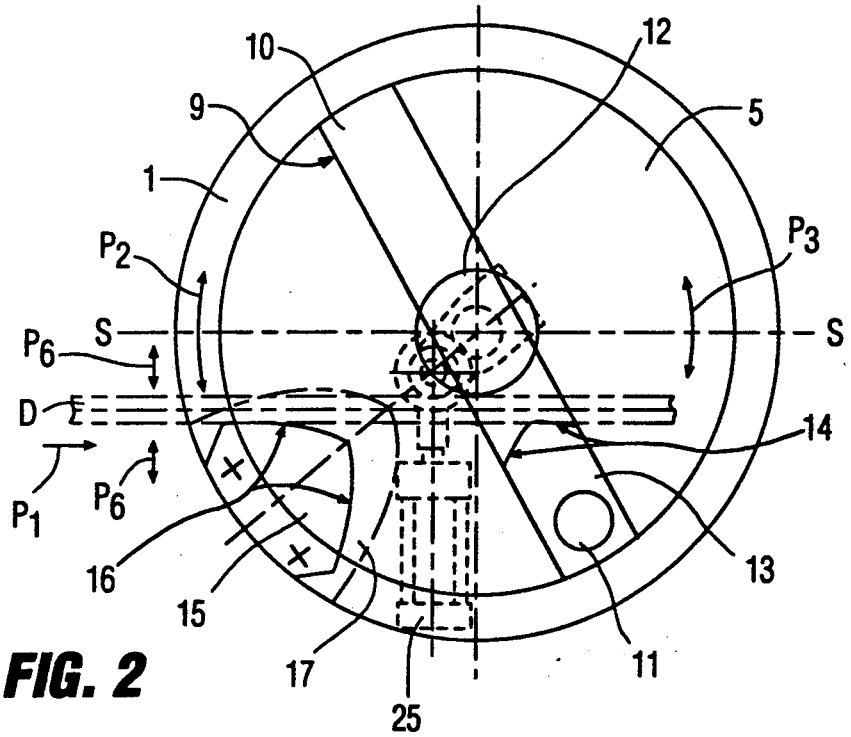
Figure 3:
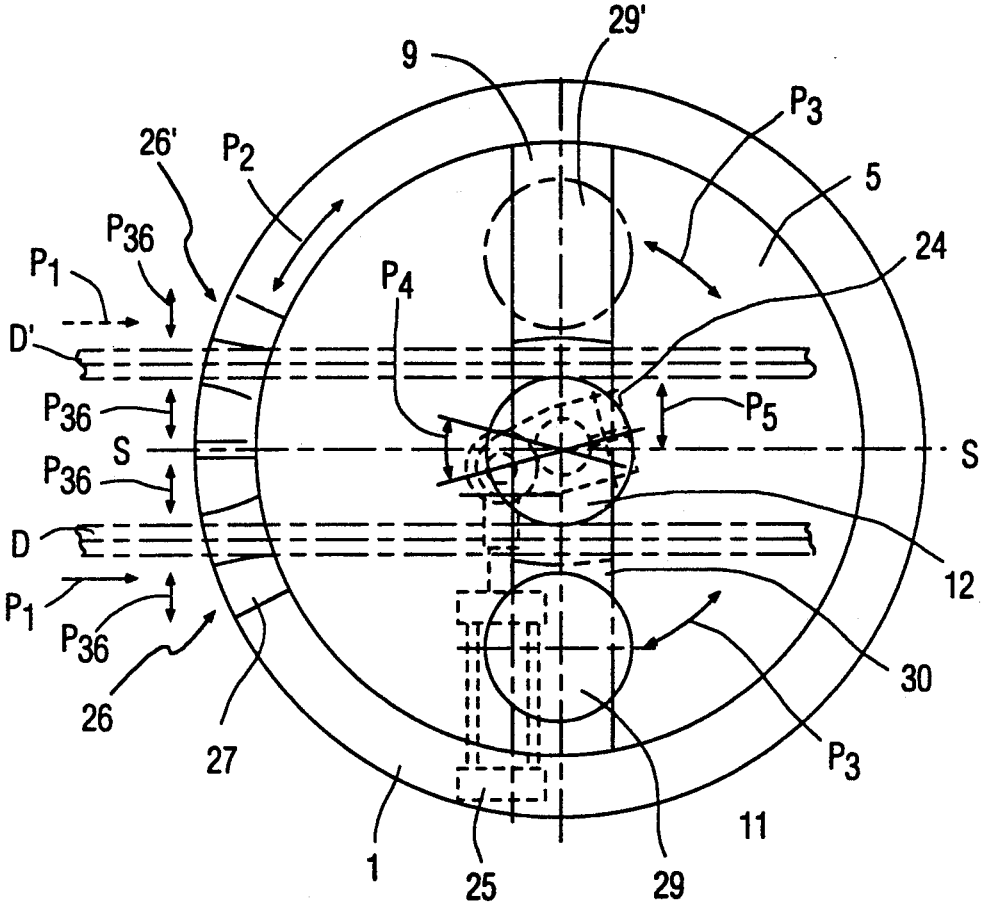

Other features of the invention will be explained in further detail below in terms of exemplary embodiments, referring to the drawings; shown are:

FIG. 1, a schematic section through an exemplary embodiment of a bending machine according to the invention;

FIG. 2, in a plan view, the arrangement of the bending tools and steadying arm in the machine of FIG. 1 for a counterclockwise bending direction; and FIG. 3, the arrangement of the bending tools and steadying arm in a further exemplary embodiment of a bending machine according to the invention.

In FIG. 1, a cylindrical housing 1 can be seen, which via a bearing journal 2 and a bearing 3 is supported rotatably about an axis X—X in a stationary, schematically shown frame 4. In the housing 1, a bending disc 5 is supported coaxially with the housing and rotatably about the axis X—X by means of a hub 6, via a bearing 7 on a journal 8 joined to the bearing journal 2. On its top, the bending disc 5 has a diagonally extending groove 9, into which a bending control arm 10 can be interchangably inserted; at the same time, this control arm is slipped onto an eccentrically located support journal 11 of the bending disc 5. The bending control arm 10 has a central bending mandrel 12, the axis of which coincides with the axis X—X, and an eccentrically arranged bending body 13 surrounding the support journal 11. The bending body 13 has two bending faces 14, at an angle from one another (see FIG. 2), which in the bending operation form the bearing surfaces for the material to be bent. However, the bending body 13 may be formed cylindrically instead.

The bending mandrel 12 and the bending body 13 are adapted in their dimensions and their mutual spacing to the dimensions of the material to be bent. The working faces of the bending mandrel 12 and bending body 13 may be roughened, for instance knurled, in order to increase the frictional engagement between these faces and and the material to be bent.

The housing 1 also has an interchangeable steadying element or arm 15 with slightly curved stop faces 16, at an angle from one another, on which the material to be bent is supported during the bending operation. Within the scope of the invention, the steadying arm 15 may also be cylindrically shaped and may be rotatably secured to the housing 1.

If the dimensions of the material to be bent change, then in order that the appropriate spacings of the bending tools from the steadying arm will always be adhered to, or in other words so that the same bending conditions will always prevail when the dimensions of the material vary, the steadying arm 15 can be replaced by another one, or a steadying arm shoe 17, shown in dot-dash lines in FIG. 2, can be fitted over the original steadying arm 15.

A rotary drive motor 18 is eccentrically mounted on the housing 1, and its drive pinion 19 meshes with a ring gear 20 provided on the hub 6 of the bending disc 5. A rotational angle encoder 21 provided with a measuring wheel 22 is also secured to the housing 1; the measuring wheel 22 engages the inside of the ring gear 20 without play and makes it possible to measure the rotational angle between the bending disc 5 and the housing 1.

A swivel arm 24 is secured to the lower clamping journal 23 of the bearing journal 2, and by way of the swivel arm the housing 1 can be pivoted about the axis X—X in accordance with the double arrow $P_4$ (FIG. 3), with the aid of a swivel drive mechanism embodied for instance as a hydraulic work cylinder 25.

In FIG. 2, the bending tools 12, 13 and the steadying arm 15 are each shown in their starting position for bending a wire D counterclockwise. The wire D is guided parallel, eccentrically relative to a central line S—S and with play, between the bending mandrel 12 and the bending body 13 with the aid of clamping jaws, not shown, and which exert clamping forces $P_6$ on the wire D in the direction of the arrow $P_1$. At that time the steadying arm 15 is located on the same side of the wire as the bending body 13.

Next, the swivel drive mechanism 25 is switched off, and the rotary drive motor 18 is put into operation, via a control device or control unit shown schematically at CU, as a result of which which the housing 1 and the steadying arm 15 rotate as indicated by the upper point of double arrow $P_2$ (FIG. 2) until such time as the steadying arm 15 rests on the wire D, as a result of which the rotary motion of the housing 1 is ended. The rotary drive motor 18 then continues to be driven in the same direction, as a result of which the bending disc 5 rotates as indicated by the upper point of double arrow $P_3$, that is, opposite to the previous rotation of the housing 1, until the bending body 13 rests with its bending face 14 on the wire D and the wire is firmly clamped between the bending mandrel 12 and the bending body 13. If the rotary drive motor 18 is then driven onward in the same direction, the bending disc 5 continues to rotate in the direction of the upper point of double arrow $P_3$ (FIG. 2) and in so doing bends the wire D about the bending mandrel 12.

In this bending process the relative motion between the then stationary housing 1, propped against the wire D by means of the steadying arm 15, and the rotating bending disc 5 is measured continuously with the aid of the rotational angle encoder 21, and thus the bending angle of the wire D is also measured continuously. This measured value is supplied to the control device CU, which drives the rotary drive motor 18 until such time as the preselected set-point bending angle is attained. During the bending operation, the wire D remains clamped between the bending mandrel 12 and the bending body 13 and slides along the smooth stop face 16 of the steadying arm 15 as indicated by the arrow $P_1$. After the end of the bending operation, the swivel drive mechanism 25 and the rotary drive motor 18 are driven in the opposite direction, causing the bending disc 5 and the housing 1 each to rotate in the opposite direction in such a way that the steadying arm 15 and the bending body 13 move toward one another, releasing the wire D, and return to their outset positions.

By means of the jaws acting to apply the clamping force $P_6$, the wire can now be advanced in the direction of the arrow $P_1$, and another bend in the same direction, as described above, can be performed. However, if a bend in the clockwise direction or in other words in the opposite direction is desired, then the wire to be bent is lifted parallel to the axis X—X, with the aid of the clamping jaws, far enough from the bending disc 5 that the steadying arm 15 and the bending body 13 can be moved underneath the wire to the other side, and the wire can be raised above the bending mandrel 12 to a position on the other side of the bending mandrel 12.

The housing 1 and thus the steadying arm 15 are moved to a position, with the aid of the swivel arm 24, that is a mirror image, with respect to the central line S—S, of the position shown in FIG. 2. While the housing 1 is firmly held in this position with the aid of the swivel arm 24, the bending disc 5 is then, by triggering of the rotary drive motor 18, rotated far enough that the bending body 13 assumes a position that is a mirror image of the position shown in FIG. 2 relative to the central line S—S.

The wire is now lifted over the bending madrel 12 with the aid of the clamping jaws and lowered vertically to the surface of the bending disc 5 between the bending mandrel 12 and the bending body 13.

The supporting of the steadying arm 15, the firm clamping of the wire between the bending mandrel 12 and the bending body 13, and the bending operation then ensue in the same manner as described above, but in the opposite rotational direction.

FIG. 3 shows a further exemplary embodiment of a bending machine according to the invention, in which the wire need not be raised in order to change the bending direction. The steadying arm 26 comprises two fork-like parts 27 and 28, which are joined to the housing 1 and are optionally interchangeable; between them the wire D to be bent is introduced between clamping jaws, not shown, exerting clamping forces schematically shown by arrows $P_{36}$, in the direction of the arrow $P_1$. The steadying arm 26 is so formed that on the one hand it can accommodate any possible diameter of material to be bent, and on the other hand the outside dimensions of the steadying arm allow bending to be done at the maximum possible bending angle of approximately 180°.

If the bending direction is changed, the steadying arm 26 is moved to the position 26' shown in dashed lines, by rotation of the housing 1 with the aid of the swivel arm 24, which can be swiveled in the direction of the double arrow $P_4$; the wire D is carried along in this operation and moved to the position D'. In this exemplary embodiment, the central bending mandrel 12 and an eccentrically located bending bolt 29, both of them located on the bending carriage 30 and embodied identically, serve as the bending tools.

With the aid of drive elements, not shown, the bending carriage 30 is displaceable as indicated by the double arrow $P_5$ in the groove 9 of the bending disc 5 and can be fixed on the bending disc 5 by means not shown. By the displacement of the bending carriage 30, the original central bending mandrel 12 reaches a new position 29' and as a result becomes the eccentrically located bending bolt, while contrarily the original eccentric bending bolt 29 now assumes both the position and the function of the central bending mandrel 12.

Displacement of the bending carriage 30 is synchronized with the rotation of the housing 1, to enable reliable transfer of the wire D to the new starting position D'. The supporting of the steadying arm 26, by a rotation of the housing 1 as indicated by the double arrow $P_2$ by means of the rotary drive motor 18; the firm clamping of the wire between the bending mandrel 12 and the bending bolt 29, by a rotation of the bending disc 5 in accordance with the double arrow $P_3$ by means of the rotary drive motor 18; and the bending of the wire, likewise by rotation of the bending disc 5 by means of the drive motor 18, ensue in the manner already described for the exemplary embodiment of FIGS. 1 and 2.

With the bending machine according to the invention, it is possible not only to bend single wires, bars, pipes or the like, but also to bend a plurality of wires or the like simultaneously in one bending operation. In this process the steadying arm 15 or 26 and the central bending mandrel 12 and the eccentric bending tools 13, 29 must be adapted in their height to the maximum possible number and diameter of materials to be bent.

With the bending machine according to the invention, it is also possible to bend arcs having a radius of curvature that is greater than the radius of the bending mandrel 12. Since bending of the wire up to the radius of curvature of the bending mandrel 12 does not ensue until there is a rotation of the bending body 13 or bending bolt 29 by a certain amount, the ensuing bending becomes correspondingly less at smaller rotational angles. Depending on the size of the rotational angle of the bending tools 13 or 29, any arbitrary radius of curvature can be attained in the bending process. The complete bending operation is subdivided into a plurality of partial bends with corresponding partial bend angles, or in other words partial rotational angles of the bending tools 13 or 29.

Once the first bending step is completed, the bending tools 13 or 29 are rotated back to the outset position; the wire D is advanced by a partial feed increment in the direction of the arrow $P_1$ with the aid of the clamping jaws (not shown) and which exert the clamping forces $P_6$ or $P_{36}$, respectively, and a further bending step is performed. The size of the partial feed increment is defined by the quotient of the total feed to produce the finished arc and the number of individual partial bends. The bending operations and the feeding of the material are repeated in accordance with the number of partial bends often enough that the desired arc is completed. In the bending operation described above, the clamping force $P_6$ or $P_{36}$ supplying mechanism, e.g. standard clamping jaws (not shown), and the rotary drive mechanism are thus driven in alternation by the central control device CU.

The exemplary embodiments described may be variously modified within the scope of the general concept of the invention; this is particularly true of the individual drive mechanisms.

We claim:

1. A bending machine for bending bar-shaped material in two directions, having
   - a stationary frame (4);
   - a single bending disc (5) rotatable about a fixed central axis (x—x);
   - a central bending mandrel (12) on the disc (5);
   - an eccentrically located bending tool (13, 29) on the disc;
   - a housing (1) rotatably supported for rotation in two opposite directions about the axis (x—x) on the stationary frame (4);
   - an adjustable steadying element (15, 17, 26) secured to the housing, for holding the material to be bent against the disk (5);
   - wherein the bending disc (5) is located coaxially with the housing;
   - the bending mandrel is coaxial with respect to said axis (x—x);
   - a rotary drive mechanism (18) is provided, mounted on the housing (1) and drivingly coupled to the bending disc (5); and
   - wherein the steadying element (15, 17, 26) is eccentrically located on the housing, rotation of the housing by said rotary drive mechanism resulting in engagement of the material to be bent against said steadying element.

2. The machine of claim 1, further comprising
   - a swivel arm (24) coupled to the housing (1) to permit coarse positioning of the steadying element (15, 17, 26), and adjustment of the position of the housing in a predetermined position, as determined by a selected bending direction, under control of said swivel arm (24);
   - a bearing journal (2, 23) retaining the swivel arm on the housing; and
   - a swivel drive mechanism (25) coupled to the swivel arm for operating the swivel arm (24) to determine the position of the housing with respect to the selected bending direction.

3. The machine of claim 2, wherein the bearing journal has two end portions; and
   - wherein the bending disc (5) is rotatably supported on one end portion of the bearing journal (2, 23) of the housing and the swivel arm (24) at another end portion.

4. The machine of claim 2, further including a control device (CU), selectively controlling the rotary drive mechanism (18) and operation of said swivel drive mechanism (25).

5. The machine of claim 1, further including a bending carriage (30);
   - wherein the bending disc (5) is formed with a diagonal groove; and
   - the central bending mandrel (12) of the eccentrically located bending tool (29) are located on the bending carriage (30),
   - the bending carriage being displaceable in the diagonal groove (9) of the bending disc; and
   - wherein the carriage (30) is securable in a predetermined position on the bending disc.

6. The machine of claim 5, wherein the bending mandrel (12) and the bending tool (29) are identically shaped.

7. The machine of claim 1, wherein the bending disc (5) is formed with a diagonal groove (9);
   - a bending carriage (10) is provided, insertable into the diagonal groove (9) of the bending disc;

and wherein the eccentrically located bending tool (13) and the central bending mandrel (12) are located on the bending carriage (10).

8. The machine of claim 1, wherein the bending mandrel (12) and the bending tool (13, 29) are formed with work faces which are roughened.

9. The machine of claim 1, wherein the steadying element (15) comprises an essentially cylindrically shaped, rotatably retained on the housing (1).

10. The machine of claim 1, wherein the steadying element (26) comprises a fork-shaped element defining two fork tines or parts (27, 28) to receive the material to be bent.

11. The machine of claim 1, further including a measuring instrument (21) measuring the relative rotary motion ($P_3$) of the bending disc (5) with respect to the housing during a bending operation; and a control device (CU) is provided, receiving data from said measuring instrument (21) representative of the measured value of said relative motion.

12. The machine of claim 1, wherein a controllable clamping mechanism ($P_6$, $P_{36}$) is provided for feeding material to be bent and clamping the material as it is being bent, said controllable clamping mechanism being arranged to permit positioning and re-positioning thereof with respect to the bending mandrel upon change in bending direction.

13. The machine of claim 1, wherein the steadying element (15, 17, 26), the bending mandrel (12) and the bending tool (13, 29) are of sufficient size to accept a plurality of bar-shaped materials for simultaneously bending said plurality of bar-shaped material.

14. The machine of claim 1, wherein a controllable clamping mechanism ($P_6$, $P_{36}$) is provided for clamping and feeding material to be bent; and wherein the rotary drive mechanism (18) is selectively operable independently of said clamping mechanism ($P_6$, $P_{36}$) or in timed association therewith, to permit alternate drive of the rotary drive mechanism (18) and the clamping mechanism and feed of material, said alternate drive and feed permitting determination and control of the bending diameter of the bar-shaped material to be bent.

15. The machine of claim 14, further including a control device (CU) controlling, selectively, the operation of said drive mechanism (18) and the clamping mechanism ($P_6$, $P_{36}$).

16. The machine of claim 15, further including a measuring instrument (21) measuring the relative rotary motion ($P_3$) of the bending disc (5) with respect to the housing during a bending operation; and wherein the control device (CU) receives data from said measuring instrument (21) representative of the measured value of said relative motion.

17. The machine of claim 1, wherein said rotary drive mechanism (18) comprises a motor, eccentrically secured to said housing, and having a motor drive shaft, the motor drive shaft being coupled to the bending disc (5) to transfer relative rotation between the housing (1) and the bending disc to the bending disc upon arresting rotary movement of the housing due to engagement of the bar-shaped material with the steadying element (15, 17, 26) secured to the housing, continued rotation of the drive motor causing relative rotation between the bending disc (5) and the housing, and hence rotation of the bending tool, and bending of said bar-shaped material.

18. The machine of claim 5, wherein the bending mandrel (12) and the bending tool (29) are cylindrically shaped and identical.

* * * * *